United States Patent [19]

Brumbaugh

[11] 4,040,551

[45] Aug. 9, 1977

[54] SKI AND SKI POLE CARRIER

[76] Inventor: Andrew L. Brumbaugh, Rte. No. 1, Wyalusing, Pa. 18853

[21] Appl. No.: 692,102

[22] Filed: June 2, 1976

[51] Int. Cl.[2] ..... B65D 71/00

[52] U.S. Cl. ..... 224/45 S; 24/73 SG; 24/81 SK; 211/60 SK; 280/11.37 A

[58] Field of Search ..... 224/45 S, 45 R, 49, 224/5 Z, 55; 280/11.37 K, 11.37 A, 11.37 C; 24/73 SG, 81 SK; 70/58; 211/60 SK; 206/315

[56] References Cited

U.S. PATENT DOCUMENTS

| | | | |
|---|---|---|---|
| 3,278,097 | 10/1966 | Duckworth | 224/55 |
| 3,342,388 | 9/1967 | Duckworth | 224/45 S |
| 3,718,242 | 2/1973 | Larson | 224/45 S |
| 3,830,416 | 8/1974 | Smedley | 224/5 Z |
| 3,905,610 | 9/1975 | Dini | 224/45 S X |
| 3,947,927 | 4/1976 | Rosenthal | 224/45 S X |
| 3,976,234 | 8/1976 | Moudry et al. | 224/45 S |

FOREIGN PATENT DOCUMENTS

| | | | |
|---|---|---|---|
| 473,301 | 3/1929 | Germany | 280/11.37 A |
| 331,720 | 7/1958 | Switzerland | 224/5 Z |

*Primary Examiner*—L. J. Paperner
*Assistant Examiner*—Donald W. Underwood
*Attorney, Agent, or Firm*—Allen D. Brufsky

[57] ABSTRACT

A transporting device is provided for carrying skis and ski poles. The device includes an upper clamping assembly interconnected to a lower clamping assembly. The upper clamping assembly and the lower clamping assembly each include at least one ski pole clamp pivotably and releasably secured to at least one ski clamp.

9 Claims, 8 Drawing Figures

SKI AND SKI POLE CARRIER

BACKGROUND OF THE INVENTION

The present invention relates generally to a ski and ski pole carrier apparatus and, more particularly to apparatus which can be used by an individual skier to easily carry his or her skis and ski poles and yet maintain the skis and ski poles in a fixed position for transportation and storage.

A problem commonly experienced by most skiers, particularly novices, is how to hand carry their skis and ski poles when they are not in actual use. The problem is further compounded by the fact that the ground may not always be level and may be slippery due to a snow or ice cover. Due to the awkward length of skis and ski poles, it is not uncommon for them to cause a skier to fall or otherwise pose a general hazard to people in the area, particularly when carried by the skier in a horizontal position. As such, it is preferred that a carrier device be provided wherein the skis and ski poles are maintained in a fixed vertical position.

In the past, numerous types of sling devices have been used to carry skis and ski poles. Examples of such devices include those described in U.S. Pat. Nos. 2,118,875 to L. Windheim; 3,830,416 to R. W. Smedley; and 3,841,542 to P. C. Hogensen, Jr. These sling devices, however, fail to provide a carrier device which can be used to both transport and store the skis in a fixed position.

It is therefore an objective of the present invention to provide a ski and ski pole carrier apparatus which will permit the skis and ski poles to be carried by an individual skier in a vertical position.

It is another object of the present invention to provide a ski and ski pole carrier apparatus which will maintain the skis and ski poles in a fixed position for transportation and storage.

SUMMARY OF THE INVENTION

Toward the fulfillment of these and other objects, the apparatus of the present invention briefly comprises a device for transporting and storing skis and ski poles. The device comprises an upper clamping assembly interconnected to a lower clamping assembly. The upper clamping assembly and the lower clamping assembly each include at least one ski pole clamp pivotably and releasably secured to at least one ski clamp.

The ski clamp includes a plurality of interconnected side portions pivotably connected to at least two center portions to define at least two internal openings, each of which are adapted to receive and grip at least one ski.

The ski pole clamp comprises at least two curved side portions pivotably connected at one end thereof to define an inner opening for receiving and gripping at least two ski poles.

The upper clamping assembly is interconnected to the lower clamping assembly by a cable which is attached to a head assembly further included in both the upper and the lower clamping assemblies.

BRIEF DESCRIPTION OF THE DRAWINGS

The foregoing and still other objects and advantages of the present invention will be more apparent from the following detailed explanation of the invention in connection with the drawings wherein.

DESCRIPTION OF THE PREFERRED EMBODIMENTS

Figure 1:
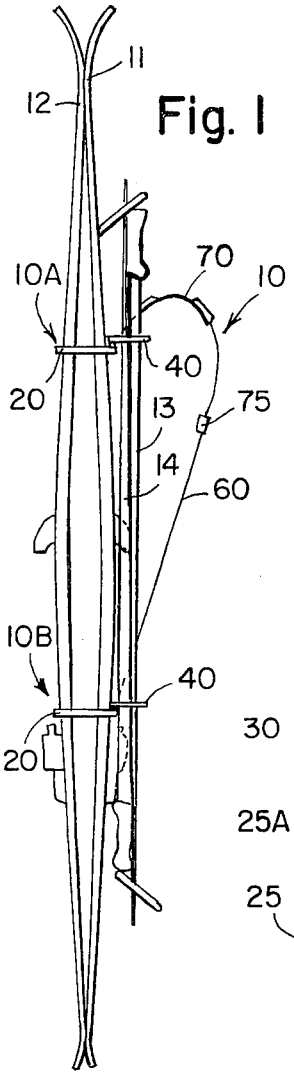
FIG. 1 is a side view of th ski and ski pole carrier of the present invention as it is in its operative position carried by an individual skier.

Referring now to the drawings and, in particular, to FIG. 1 thereof, there is shown the ski and ski pole carrier device of the present invention referred to generally by reference numeral 10 in its operative position as it supports a pair of skis 11 and 12 and a pair of ski poles 13 and 14. It will be appreciated that in its operative position, the carrier 10 maintains the skis 11 and 12 and the ski poles 13 and 14 in a vertical position relative to the ground.

The carrier apparatus 10 includes at least two sets of assemblies, an upper clamping assembly and a lower clamping assembly referred to generally by reference numerals 10A and 10B respectively. The upper clamping assembly 10A, which is adapted to grip the skis 11 and 12 and the ski poles 13 and 14 at one end thereof and the lower clamping assembly 10B, which is adapted to grip the skis 11 and 12 and the ski poles 13 and 14 at the opposite end thereof, are each composed of a ski clamp 20 and a pole clamp 40 and are interconnected by means of a sling 60. The ski clamps 20 and the pole clamps 40 for both upper clamping assembly 10A and lower clamping assembly 10B are identical. Any reference to ski clamp 20 and pole clamp 40 and any parts thereof will refer to the part in both the upper assembly 10A and the lower assembly 10B unless specifically stated otherwise.

Figure 2:
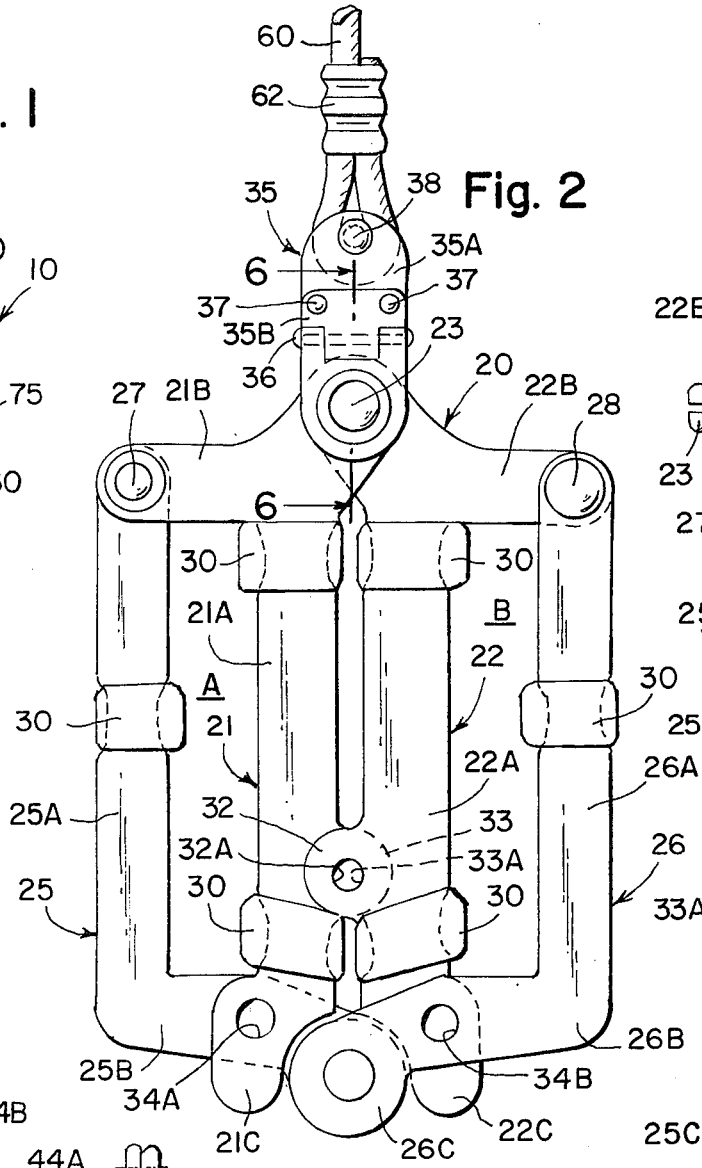
FIG. 2 is a detailed top view of the ski clamp of the ski and ski pole carrier of the present invention.
Figure 3:
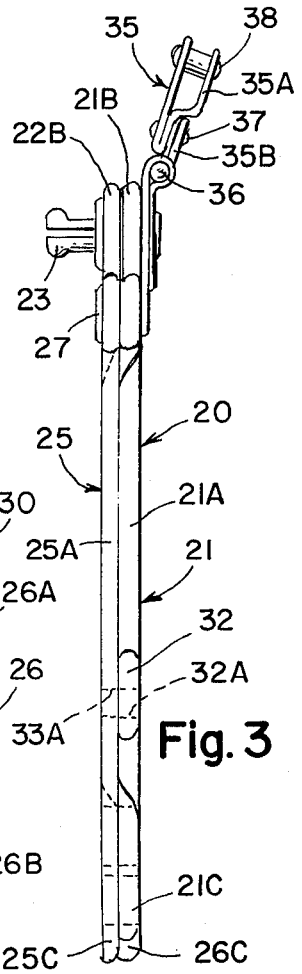
FIG. 3 is a side view of the ski clamp of FIG. 2.

The ski clamps 20, shown best in FIGS. 2 and 3, include a pair of center posts 21 and 22 which are generally L-shaped, each having a longer dimensioned leg 21A and 22A, respectively, and a perpendicularly extending shorter dimensioned leg 21B and 22B, respectively. The center posts 21 and 22 are so positioned that their longer dimensioned legs 21A and 22B are in parallel alignment and the shorter dimensioned legs 21B and 22B extend perpendicularly to the longer dimensioned legs 21A and 22A and in opposite directions from one another. The center posts 21 and 22 are pivotably connected by a lug 23 which passes through apertures contained on each of the shorter dimensioned legs 21B and 22B of the center posts 21 and 22.

A pair of generally L-shaped outer posts 25 and 26 are further provided, each of which include a longer dimensioned leg 25A and 26A, respectively and a perpendicularly extending shorter dimensioned leg 25B and 26B. The outer posts 25 and 26 are pivotably connected to the center posts 21 and 22 by rivets 27 and 28 which interconnect the longer dimensioned legs 25A and 26A of the outer posts 25 and 26 to the shorter dimensioned legs 21B and 22B, respectively, of the center posts 21 and 22 thus forming an essentially rectangularly shaped ski clamp apparatus 20 which includes an opening A between the longer dimensioned legs 21A and 25A and an opening B between the longer dimensioned legs 22A and 26A to accommodate and grip skis. Pin 27 passes through apertures in the distal ends of the shorter dimensioned leg 21B and the longer dimensioned leg 25A and pin 28 passes through apertures in the distal ends of the shorter dimensioned legs 22B and the longer dimensioned leg 26A.

A plurality of cushions 30 may be provided at recessed points along center posts 21 and 22 and the outer posts 25 and 26 preferably at points where they are to contact the ski so as to provide protection for the ski. The cushions 30 should preferably encircle the leg at its recessed portion and may be fabricated from an elastomeric material such as, for example, by extrusion or injection molding.

The ski clamp 20 is locked in place with one or more skis in the space A between the longer dimensioned legs 21A and 25A and one or more skis in the space B between the longer dimensioned legs 22A and 26A by means of locking loops 25C and 26C contained respectively on the distal ends of the shorter dimensioned legs 25B and 26B of the outer posts 25 and 26 and tabs 21C and 22C contained respectively on the distal ends of the longer dimensioned legs 21A and 22A of the center posts 21 and 22. The locking loops 25C and 26C are adapted to be captured between the tabs 21C and 22C, thus locking the ski clamp 20 in its operative position with the skis locked in spaces A and B. The skis may be removed by exerting pressure against the tabs 21C and 22C in opposite directions, thus freeing the locking loops 25C and 26C and permitting the outer posts 25 and 26 to be opened to provide access to the skis. Similarly, pressure applied in opposite directions against the tabs 21C and 22C will allow insertion of the locking loops 25C and 26C between the tabs 21C and 22C and lock the ski clamp 20 in a closed position.

A locking member 32 is included on the inside portion of the longer dimensioned leg 22A ofthe center posts 22 and includes an aperture 32A. The locking member 32 is positioned relative to a complimentary locking member 33 on the inside portion of the longer dimensioned leg 21A of the center post 21 which also includes an aperture 33A. When the clamp assembly 20 is in a closed position, the aperture 32A is in axial alignment with the aperture 32A of the locking member 32. In this manner, a locking element (not shown) may be inserted to prevent unauthorized opening of the clamp and removal of the skis. Similarly, a stud (not shown) may be inserted through an aperture 34A passing through tab 21C and shorter dimensioned leg 25B and a stud (not shown) may be inserted through an aperture 34B passing through tab 22C and shorter dimensioned leg 26B.

The ski clamps 20 of the upper and lower clamping assemblies 10A and 10B, respectively, are interconnected by means of a sling 60 which is connected to the ski clamp 20 at each end thereof by means of a head assembly 35 pivotably connected to the ski clamp 20 at the lug 23. The head assembly 35, best shown in FIGS. 2 and 3, includes an upper portion 35A connected to the sling 60 and a lower portion 35B including a pin hinge 36, which is pivotably connected to the ski clamp 20 by lug 23 which passes through an aperture in the lower portion 35B. The upper and lower head assembly portions 35A and 35B are secured to one another by one or more rivets 37. Pin hinge 38 allows the head assembly 35 to rotate forward and backward relative to the ski clamp 20. The sling 60 which may be a cable, is secured to the upper head assembly 35A by passing an end of the sling 60 around a tubular connector 38 secured to the both sides of the upper head assembly 35A and clamping the end of the sling 60 within a clamp 62.

Figure 4:
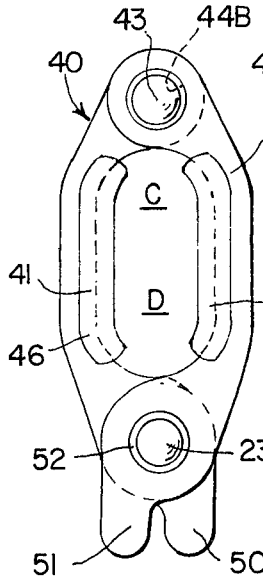
FIG. 4 is a detailed top view of the ski pole clamp of the ski and ski pole carrier of the present invention.
Figure 5:
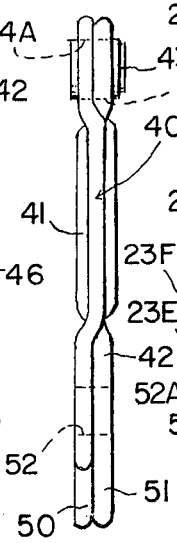
FIG. 5 is a side view of the ski pole clamp of FIG. 4.

The pole clamp 40, as shown in FIGS. 4 and 5, comprised of two opposed curved portions 41 and 42 which are pivotably connected about a stud 43 which passes through pivot apertures 44A and 44B at one end of the curved portions 41 and 42. Pivot apertures 44A and 44B are in axial alignment when one end of curved portion 41 overlapped with an end of opposed portion 42 in its operative position. The pole clamp 40, in its operative position with opposed curved portions 41 and 42 pivotably connected by stud 43 define a larger diameter inner cavity C and a smaller diametered inner cavity D. Elastomeric cushions 46 may be provided on the inner surfaces of curved portions 41 and 42 to protect the ski poles. Cavities C and D are adapted to grip the shaft portions of the ski poles 13 and 14 which in their operative position, are alternately positioned, with the handle of pole 13 above the upper assembly 10A and with the handle of pole 14 below the lower assembly 10B. The pole clamp 40 includes apertures at the other end of curved portions 41 and 42 from pivot apertures 44A and 44B with a tubular stud 52 contained within these opposite apertures. Tabs 50 and 51 are provided at this outer end of curved portions 41 and 42.

Figure 6:
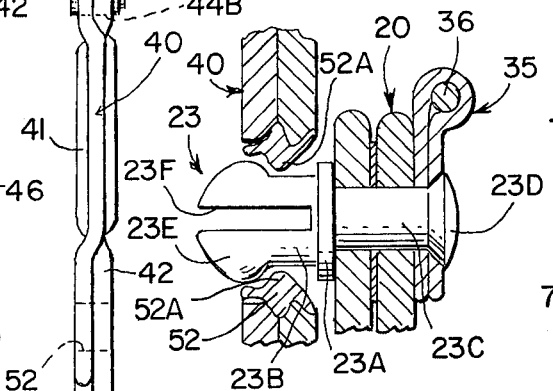
FIG. 6 is a cross-sectional view taken along the line 6—6 of FIG. 2.

The pole clamp 40 is pivotably connected to the ski clamp 20 about leg 23 which passes through the tubular stud 52 within the pole clamp 40 and through the apertures within the ski clamp 20 and the head assembly 35. As best shown in FIG. 6, the lug 23 includes a central shoulder 23A positioned between the pole clamp 40 and the ski clamp 20 and head assembly 35. A larger diametered shank portion 23B and smaller diametered shank portion 23C extend axially from the shoulder 23A in opposite directions, the larger diametered shank portion 23B passing through the tubular stud 52 in the pole clamp 40 and the smaller diametered shank portion passing through apertures in the ski clamp 20 and the head assembly 35. The smaller diametered shank portion 23C secures the head assembly 35 in juxtaposition to the ski clamp 20 by flanged portion 23D on the end of the smaller diametered shank portion opposite from the shoulder 23A which grips the head assembly 35. Similarly, the larger diametered shank portion 23B secures the pole clamp 40 to the ski clamp 20 and the head assembly 35 by an enlarged head portion 23E at the end of the larger diametered shank portion 23B opposite from the shoulder 23A which is adapted to grip the pole clamp 40. An axially extending slot 23F extending from the enlarged head 23E through the diametered shank portion 23B is provided to, upon compression, allow the enlarged head23E of the key 23 to pass through the tubular stud 52 within the pole clamp 40 for removal.

The tubular stud 52 includes a raised center portion 52A which provides a smaller diametered portion of the opposite apertures in the pole clamp 40. The diameter of the opening of the opposite apertures at the raised center portion 52A of the tubular stud 52 is slightly greater than the diameter of the larger diametered shank portion 23B of the lug 23 and is slightly less than the enlarged head portion 23E of the lug 23. In this manner, upon application of opposite pressure on the tabs 50 and 51 of the pole clamp 40, the enlarged head portion 23E of the lug 23 will be disengaged from the raised center portion 52A of the tubular stud 52 for removal of the ski poles. Similarly, upon application of pressure in opposite directions against the tabs 50 and 51, after insertion of the poles, the pole clamp 40 may be locked in place.

Figures 7, 8:
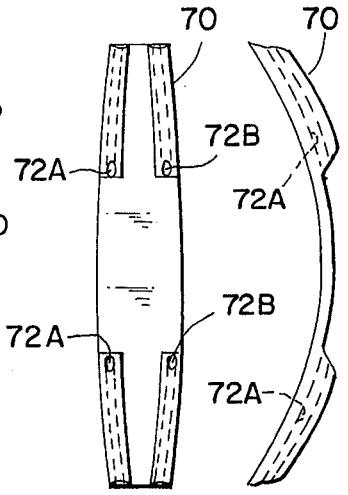
FIG. 7 is an elevational view of the sling portion of the ski and ski pole carrier of the present invention.
FIG. 8 is a side view of the sling portion of FIG. 7.

As previously stated, the upper clamping assembly 10A is connected to the lower clamping assembly 10B by a sling 60 which is attached by crimps 62 to the head assembly 35 of the upper assembly 10A and the lower assembly 10B. The sling 60 may be one or more cables such as, for example, braided nylon material or a coated metallic cable material. Since the sling 60 must be carried by an individual over their shoulder, a shoulder pad 70 as shown in FIGS. 7 and 8 should be included. The shoulder pad 70 which is preferably fabricated from an injection molded flexible thermoplastic material, includes internal tubular portions 72A and 72B to accommodate the cable of the sling 60. A conventional adjustable take-up reel 75 as shown in FIG. 1 may be provided to adjust to the height of the skier.

Having thus described the invention with particular reference to the preferred forms thereof, it will be obvious that various changes and modifications may be made therein without departing from the spirit and scope of the invention as defined in the appended claims.

I claim:

1. A transporting device for skis and ski poles, said device comprising an upper clamping assembly interconnected to a lower clamping assembly, said upper clamping assembly and said lower clamping assembly each including at least one ski pole clamp pivotably and releasably secured to at least one ski clamp, said at least one ski clamp is pivotably and releasably secured to at least one pole clamp by means of a lug passing through apertures within said ski clamp and said pole clamp, said lug including a shoulder portion positioned between said ski clamp and said pole clamp with a large diametered shank portion extending through the aperture in said pole clamp and being secured thereto by an enlarged head portion and an oppositely extending smaller diametered shank extending through the aperture in said ski clamp and being secured thereto by a flanged portion.

2. The transporting device of claim 1 wherein said at least one ski clamp comprises a plurality of interconnected side portions pivotably connected to at least two center portions to define at least two internal openings, each of said openings adapted to receive therein and grip at least one ski.

3. The transporting device of claim 2 further including means for releasably securing said plurality of interconnected side portions in order to secure said skis within said at least two internal openings.

4. The transporting device of claim 3 wherein said means for releasably securing comprises the inclusion on each of at least two adjacent side portions a locking loop which is adapted to releasably engage tabs which are included on the adjacent ends of said at least two center portions.

5. The transporting device of claim 1 wherein said at least one ski pole clamp comprises at least two opposed curved portions pivotably connected at one end thereof, said curved portions defining an inner opening for receiving and gripping at least two ski poles.

6. The transporting device of claim 5 wherein said at least one ski clamp includes means for releasably securing said curved portions in order to secure said at least two ski poles within said inner opening.

7. The transporting device of claim 6 wherein said inner opening includes a larger diametered portion and a smaller diametered portion.

8. The transporting device of claim 1 wherein said upper clamping assembly is interconnected to said lower clamping assembly by a cable, said cable being secured to each of said upper and lower clamping assemblies by a head assembly pivotably connected to said pole clamp and said ski clamp.

9. The transporting device of claim 8 wherein a shoulder pad of an injection molded plastic is included on said cable.

* * * * *